United States Patent [19]

Rowland et al.

[11] 3,995,998

[45] Dec. 7, 1976

[54] METHOD OF POLYMERIZING AND FIXING CARBOXYL-CONTAINING VINYL MONOMERS IN HIGH CONVERSION ON FIBROUS SUBSTRATES

[75] Inventors: Stanley P. Rowland; Vidabelle O. Cirino; Earl J. Roberts, all of New Orleans, La.

[73] Assignee: The United States of America as represented by the Secretary of Agriculture, Washington, D.C.

[22] Filed: Aug. 28, 1974

[21] Appl. No.: 501,419

[52] U.S. Cl. ..... 8/115.6; 8/115.5; 8/115.7; 8/116 R; 8/181; 8/194; 260/17 A; 260/17.4 GC; 427/385 R; 427/390 E

[51] Int. Cl.[2] ..... D06M 13/20; D06M 15/14

[58] Field of Search ..... 8/115.6, 115.5, 115.7; 260/17 A, 17.4 GC

[56] References Cited

UNITED STATES PATENTS 3,125,405 3/1964 Gardon ..... 260/17 A 3,652,212 3/1972 Machell ..... 8/115.6

*Primary Examiner*—Wilbert J. Briggs, Sr.
*Attorney, Agent, or Firm*—M. Howard Silverstein; Salvador J. Cangemi; David G. McConnell

[57] ABSTRACT

A fibrous material consisting of cellulosic or other natural fiber, synthetic fibers, or blends of various fibers is treated with an aqueous reagent system having a pH above 3.6 that is comprised of one or more carboxyl-containing vinyl monomers, a free-radical initiator, and a suitable base to adjust the pH. Comonomers and water-soluble di- or polyfunctional vinyl monomers may be included. Polymerization is conducted at elevated temperature in an atmosphere in which air may be diluted by steam and/or steam-nitrogen. The polymer is durably fixed to the fibrous substrate and contributes various special performance properties thereto.

4 Claims, No Drawings

METHOD OF POLYMERIZING AND FIXING CARBOXYL-CONTAINING VINYL MONOMERS IN HIGH CONVERSION ON FIBROUS SUBSTRATES

BACKGROUND OF THE INVENTION

The present invention relates to the fixation of water-soluble, carboxyl-containing vinyl monomers on fibrous substrates in the form of polymeric compositions and to the method of accomplishing the same.

Methods have been provided for the deposition of preformed polymeric materials on fibers or fabric substrates and for the development of graft polymers on fibrous or fabric substrates. The deposition of preformed polymers provides a means for modifying the surface properties of fibers and fabrics, but this method is characterized by several limitations and deficiencies. The preformed polymer is viscous if dissolved in the medium in which it is applied; or it is present in a particulate form as an emulsion or dispersion in a continuous phase which is often water. In either case the penetration of the polymer into the fabric or the yarns or the fibers occurs slowly, being limited by the size of the dispersed particles or the size of the molecular species. As a consequence, penetration is limited and is relatively poor, polymer concentrates at fiber crossover points, and stiffness becomes pronounced even at low levels of polymer deposition.

In the case of graft polymerization on fibers and fabric substrates, numerous methods are now known for accomplishing such reactions. The most common reactions involve free-radical initiation by one of a variety of means such as peroxide catalyst, high or low energy irradiations, heat, oxidation-reduction reactions, and electrical discharge. Each of these means of generating free radicals is subject to practical limitations as described by K. Hoshino in Chemical Aftertreatment of Textiles, ed. H. F. Mark, M. S. Wooding, and S. M. Atlas, Chapter VB, p. 235, Wiley-Interscience, New York, 1971, by E. H. Immergut in Encyclopedia of Polymer Science and Technology, Vol. 3, p. 242, Interscience Publishers, New York, 1965, and by J. C. Arthur, Jr. in Macromolecular Chemistry, Vol. 2, p. 1, Academic Press, London, 1970.

Two interrelated problems appear to be responsible for the difficulties experienced in thorough cleaning (and preventing soil staining) of fabrics composed of polyester, nylon, or durable-press synthetic fiber/cotton blends in aqueous wash baths such as employed in home and commercial laundry washing machines. Compared to unmodified cotton, synthetic fibers and durable-press cotton fibers display somewhat more hydrophobic surface properties that prevent good water penetration in the fibers for removal of soil therefrom; moreover, synthetic fibers are of an oleophilic nature. Thus the first problem involves the attraction of dirt and oily grime to the synthetic fibers; these become embedded therein and are not removed during subsequent washing cycles because of the inability of water to thoroughly penetrate the synthetic fibers in a manner similar to the swelling of unmodified cellulosic fibers in water. Second, and also due to the above described surface properties, oily soil materials that are washed out of the fabric during the laundering operation are continuously attracted to the surface of the fabric and become redeposited thereon. As a result, the fabric never returns to a truly clean condition and, instead, assumes a discolored, stained appearance which eventually renders it unfit for further use. The present invention obviates the problem of soiling and staining by modifying the surface characteristics of natural and synthetic fiber-containing fabrics, as fully disclosed hereinafter.

A substantial increase in the hydrophilic characteristics of chemically modified or finished cotton, cotton/synthetic fiber blends, and synthetic fibers is desirable and consistent with improvements in antistatic characteristics and comfort in apparel as well as improvements in soil release and the reduction in soil redeposition.

It is accordingly a primary object of the present invention to provide for a deposition and polymerization of water-soluble carboxyl-containing vinyl monomers, alone and in combination with other vinyl monomers, in and on fibrous and fabric substrates in a single stage operation utilizing a single aqueous reaction medium for conveying the reactions systems to the fibers or fabrics.

It is further object of the present invention to provide a simplified method of simultaneous polymerization and crosslinking to form a network polymeric material deposited in and on the fibrous or fabric substrate in a highly durable manner.

It is another object of the present invention to provide a process of fixing polymers on fibrous and fabric substrates with high efficiency of conversion of monomers so that the monomers are neither wasted by polymerization in a solution phase away from the substrate nor are lost by volatilization in the curing step.

It is a still further object of the present invention to produce chemically modified fibers and fabrics that are improved in hydrophilic characteristics, comfort, soil release, resistance to soil redeposition, antistatic properties, dyeing behavior, and pleasing hand.

It is an additional object of the present invention to achieve the modification of surface and bulk properties of fibers, yarns, and fabrics by an efficient polymerization and fixation of monomers, which reactions do not depend upon grafting or polymer chain initiation from the molecular chains of the substrates for development of durable fixation of the polymer to the substrate.

It is another object of this invention to provide a process for the fixation of polymers in and on fibrous substrates, which process is free of one or more of the limitations or disadvantages of prior art coating processes involving preformed polymers or prior art graft polymerization processes.

THE INVENTION

It has now been found that certain carboxyl-containing vinyl monomers can be deposited, polymerized, and fixed rapidly and efficiently in and on various types of fibers by a process wherein the aqueous solution of carboxyl-containing vinyl monomers is brought to a pH above 3.6, combined with a free-radical initiator with or without additional comonomers, applied to a fibrous substrate, and subjected to curing conditions during which the vinyl monomer(s) is polymerized and fixed in and on the fibrous substrate.

The polymer fixation that are a subject of this invention are novel in several respects. In copending application, PC 6045, it is shown that water-soluble vinyl monomers can be polymerized and durably fixed to fibrous substrate in a simple, rapid, and effective manner. Various carboxyl-containing vinyl monomers undergo polymerization and fixation to the various fibrous substrates when treated according to the conditions described in the aforementioned application. Among the monomers cited in the aforementioned application, carboxyl-containing vinyl monomers exhibited lower levels of efficiency of conversion to polymer than other water-soluble monomers. This is not unexpected, because monomers of this type have been observed by previous investigators to be more sluggish in graft polymerization to the point that substantially less polymer was fixed or to the point that little or no polymer was formed at all.

It has now been unexpectedly discovered that the conversion of carboxyl-containing vinyl monomers to polymer under the conditions described in the aforementioned application can be increased substantially, in some cases to the theoretical maximum conversion that is possible, by raising the pH of the reaction medium above a level of 3.6 by the introduction of basic materials. carboxyl-containing vinyl monomers are moderately strong acids, readily generating pH values below 2.0 in aqueous media. For reasons that are not completely understood, it is now evident that by raising the pH of reagent solutions involving carboxyl-containing vinyl monomers to values above 3.6, the conversion of monomers to polymers is improved very substantially. While all bases are beneficial in this regard, certain bases are now effective than others in raising the efficiency of conversion of monomers to polymers. This is evidently not the simple consequence of converting the carboxyl-containing vinyl monomer to a water-soluble form, because the carboxyl-containing vinyl monomers of this invention are water soluble in the acid form. It is, therefore, surprising that raising the pH values of reagent solutions involving carboxyl-containing vinyl monomers exerts such a beneficial effect on the efficiency of conversion of monomers to polymers.

In order to achieve the desired conversions of monomers to polymers and desired fixation of these polymers to substrates, it is necessary to conduct the polymerization or curing step under controlled conditions such that contact with air during this stage is not excessive. In general, the curing step may be conducted in the complete presence of air when the transfer of heat to the substrate is achieved through conduction from hot solid surfaces such as rolls, "cans," calender, press, or conventional household iron. Similarly, special precautions to exclude oxygen or air are not essential when steam or solvent vapors are the heat transfer media. However, when the transfer of heat to the substrate impregnated with aqueous reagent solution is through the gaseous stage, it is desirable that air be diluted with an inert gas such as nitrogen, carbon dioxide, or steam; a direct blast of hot air on the fibrous substrate impregnated with the aqueous solution of reagent is undesirable and detrimental to polymerization and fixation. It is not essential that air or oxygen be completely absent; the extent of dilution that is required is relatively low since the vaporization of water from the reagent solution provides a degree of dilution that is sufficient in some cases.

Although it is not essential in order to achieve the objective of this invention, it is beneficial to include small amounts of water-soluble, di- or polyfunctional vinyl monomers. The presence of such comonomers has the general effects of raising the efficiency of conversion of monomer to polymer by a few percentage points and of improving the durability of the fixed polymer to more strenuous conditions of extraction.

The essence of the invention, then, is the realization of high levels of efficiency of conversion of certain carboxyl-containing vinyl monomers, with and without comonomers, to polymers under controlled conditions of cure that are well suited to use in textile mills to obtain modified substrates wherein the hydrophilic characteristics conferred by the fixed polymers are the basis for valuable performance qualities in the fibers, yarns, and textile products.

The primary monomers of this invention are water-soluble, carboxyl-containing vinyl compounds illustrated by the following: acrylic acid, methacrylic acid, itatonic acid, maleic acid, and fumaric acid. The comonomers of this invention are water-soluble vinyl monomers, generally selected from the acrylic monomer series, as illustrated by: acrylamides, methacrylamides, diacetoneacrylamide, and the N-alkyl and N-methylol derivatives thereof; hydroxyethylacrylamide, hydroxyethylmethacrylamide; dimethyl-2-hydroxypropylaminemethacrylimide; aminoethyl acrylate and methacrylate; hydroxyethyl acrylate and methacrylate, and hydroxypropyl acrylate and methacrylate; and dialkylaminoethyl acrylates and methacrylates.

The catalysts or initiators that are preferred for this invention are: ammonium and alkali metal persulfates, hydrogen peroxide, t-butyl-hydroperoxide, peracetic acid, and combinations of these.

Water-soluble di- or polyfunctional vinyl reagents such as methylenebisacrylamide and 1,3,5-triacrylolhexahydro-s-triazine are employed with beneficial effects in this invention.

The bases that have been found to be desirable and suitable for this invention are those involving the alkali and the alkaline earth metals, which may be employed as hydroxides, oxides, carbonates, or other less basic forms such as bicarbonates, silicates, and phosphates. Ammonia or ammonium hydroxide may be beneficially employed to neutralize the carboxyl-containing vinyl monomers of this invention. Organic bases are also effective; methyl and ethyl amines and pyridine may be employed. Quaternary ammonium hydroxides such as tetramethylammonium hydroxide tetraethylammonium hydroxide tetra(hydroxyethyl)ammonium hydroxide, and tribenzylammonium hydroxide are suitable for neutralization of the carboxy-containing monomers in the process and products of this invention. (carboxyl-containing A wetting agent is commonly employed, although not essential, to facilitate the contact of the vinyl monomers with the substrates and to aid penetration into the substrates. The agents that are preferred are alkali metal alkylsulfosuccinates and ethylene oxide derivatives of phenols and alcohols.

The following are among the substrates which may be treated by the process of this invention: cotton fibers and fabrics; rayon fibers and fabrics; paper and nonwoven fabrics; nylon fibers and fabrics; polyester fibers and fabrics; cellulose acetate and triacetate fibers and fabrics; polyethylene and polypropylene fibers and fabrics; spandex fibers and fabrics; acrylonitrile polymer and copolymer fibers and fabrics; wool, silk, jute, ramie, and flax fibers and fabrics; and blends of cotton with any and all of the fibrous materials noted above.

The vinyl monomers, initiators, and wetting agents are dissolved in water and the pH of the system is raised to value above 3.6. A portion of the carboxyl-containing vinyl monomers is thus converted to the salt form, this apparently being an essential feature of the invention because it appears to be directly responsible for a substantial increase in the rate of polymerization and the extent of conversion of monomers to polymers. The actual process of polymerization of monomers and fixation of polymers onto the various fibrous substrates involves application of the aqueous solution of monomers and initiator to the substrate, and subjection of the wet substrate to curing conditions at elevated temperatures.

DESCRIPTION OF PREFERRED EMBODIMENTS

The following examples are given to further illustrate the present invention. The scope of the invention is not, however, meant to be limited to the specific details of the examples.

EXAMPLE 1

The effects of pH and of curing conditions upon the efficiencies of conversion of monomer on fabric to polymer on fabric are illustrated in results summarized in the following table. In all of these cases the reagent solution contained 15 parts of acrylic acid, 0.5 parts of ammonium persulfate, a trace of wetting agent, ammonium hydroxide to adjust the pH to the level indicated, and water to bring the total to 100 parts by weight. Fabric was impregnated with the reagent solution and passed through squeeze rolls to obtain wet pickups in the range of 95–105%. Samples of fabric were cured under various conditions: (A) 10 minutes at 120° C in a forced draft oven followed by 8 minutes at 160° C in a forced draft oven, (B) 10 minutes at 130° C in a plastic bag followed by 8 minutes at 160° C in a forced draft oven, (C) 5 minutes at 130° C in a nitrogen-steam atmosphere followed by 8 minutes at 160° C in a forced draft oven, and (D) 10 minutes at 120° C in a nitrogen-steam atmosphere. Pin frames to maintain the fabric at the original dimensions throughout the cure were generally useful. Cured fabric samples were washed vigorously in hot running tap water for 20–30 minutes and air dried at room temperature. The conversions of monomer to polymer are calculated from the wet pickups of reagent solution and the weight gains of the air-equilibrated fabrics after vigorous washing. The reagent solution containing no base had a pH of 2. The pH values were adjusted upward with ammonium hydroxide. Results are summarized in the table below.

| pH | Cure | Add-on (%) | Conversion (%) |
|---|---|---|---|
| 2.0 | A | 2.1 | 14 |
| 2.0 | B | 4.2 | 28 |
| 2.0 | C | 4.6 | 31 |
| 2.0 | D | 4.7 | 31 |
| 4.0 | A | 4.6 | 37 |
| 4.0 | B | 7.5 | 50 |
| 4.0 | D | 7.8 | 52 |
| 6.0 | A | 8.0 | 53 |
| 6.0 | B | 11.3 | 76 |
| 6.0 | D | 10.7 | 71 |
| 8.0 | A | 8.4 | 56 |
| 8.0 | B | 10.3 | 68 |
| 8.0 | D | 11.1 | 74 |

Samples of fabric subjected to cures between aluminum plates at 140° C or by ironing with a conventional household iron at the "cotton setting" were characterized by conversions of monomer to polymer very similar to those tabulated above for curing condition D.

EXAMPLE 2

The beneficial effect of small amount of di- and polyfunctional vinyl compounds is illustrated in this example. Reagent solutions were prepared from 14.5 parts of acrylic acid, 0.2 parts of di- or polyfunctional vinyl monomer, a trace of wetting agent, ammonium hydroxide to adjust the pH to 7.0, 0.5 parts of ammonium persulfate, and water to bring the total to 100 parts by weight. The di- and polyfunctional agents were methylenebisacrylamide (I) and trisacrylolhexahydro-s-triazine (II). Samples of fabric were impregnated with reagent solutions, passed through squeeze rolls to obtain wet pickups of approximately 100%, placed on pin frames, cured (A) for 10 minutes at 120° C in a forced draft oven in air or (B) for 5 minutes at 120° C in a steam-nitrogen atmosphere, rinsed extensively in hot running tap water, and air dried. The results are tabulated below.

| Polyfunctional Vinyl Reagent | Cure | Add-on (%) | Conversion (%) |
|---|---|---|---|
| None | A | 4.1 | 27 |
| I | A | 11.8 | 79 |
| II | A | 12.9 | 86 |
| None | B | 4.6 | 31 |
| I | B | 16.1 | 107[a] |
| II | B | 17.5 | 117[a] |

[a]Apparent conversions above 100% are due to experimental error andto the fact that products of this type have higher moistureregain values than the original cotton; thus, a fractionof the apparent add-on is due to increased moisture contentin the polymer-containing fabric.

EXAMPLE 3

Reagent solutions made up to contain 14.5 parts of acrylic acid, 0.5 parts of methylenebisacrylamide, a trace of wetting agent, 0.5 parts of ammonium persulfate, ammonium hydroxide to adjust the pH to 7.0, and water to bring the total to 100 parts by weight were applied to cotton fabric by immersion and squeezing. Impregnated samples of fabric were subjected to cures as follows: (a) 40 minutes at 60° under nitrogen, (b) 20 minutes at 80° C in nitrogen, (c) 10 minutes at 100° C in nitrogen-steam, (d) 5 minutes at 120° C in nitrogen-steam, and (e) 1 minute at 160° C in nitrogen-steam. The respective conversions of monomer on fabric to polymer durably fixed to the fabric (following washing treatments as described in the preceding examples) were as follows: (a) 2.9%, (b) 77%, (c) 116%, (d) 110%, and (e) 114%.

EXAMPLE 4

The effectiveness of ammonium and sodium hydroxides for increasing the extent of conversion in polymerization of acrylic acid is illustrated in the results summarized here. Reagent solutions were prepared from 14.5 parts of acrylic acid, 0.5 parts of methylenebisacrylamide, 0.483 of ammonium persulfate, a trace of wetting agent, base to adjust the pH to the desired level, and water to bring the total to 100 parts by weight. Samples of fabrics were impregnated, cured, washed thoroughly, and air dried. The cure was for 5 minutes at 120° in an atmosphere of steam-nitrogen; the wash was a one-hour boil in distilled water following a vigorous wash in hot running tap water. The results are summarized in the table below.

| pH | Conversion (%) | |
|---|---|---|
| | $NH_4OH$ | NaOH |
| 1.8 | (29)[a] | (29)[a] |
| 3.5 | 25 | 28 |
| 4.0 | 52 | 55 |
| 5.0 | 61.3 | 104 |
| 7.0 | 65 | 125 |
| 8.8 | 69.5 | — |
| 9.6 | — | 127 |

[a]The pH value of 1.8 was the result of no neutralizationwith base.

Polymerizations that were conducted with reagent systems neutralized with LiOH and KOH resulted in polymerization efficiencies very similar to those listed above for systems neutralized with NaOH.

EXAMPLE 5

Reagent solutions were prepared to contain 14.5 parts of methacrylic acid, 0.5 parts of methylenebisacrylamide, 0.5 parts of ammonium persulfate, a trace of wetting agent, sodium hydroxide to adjust the pH to the desired level, and water to bring the total to 100 parts. Samples of cotton/polyester (50/50) blend fabric were impregnated with the reagent solutions, cured for 5 minutes at 120° in steam-nitrogen, washed vigorously in hot running tap water and boiled for one hour in distilled water, and air dried at room temperature. The percentages of conversion of monomer on fabric to durably-attached polymer on fabric were as follows: at pH 2.2 (no neutralization), 10%; at pH 3.5, 11%; at pH 4.0, 35%; at pH 5.0, 51%; at pH 7.0, 82%; and at pH 11.0, 75%.

EXAMPLE 6

Reagent solutions were prepared to contain 14.5 parts of acrylic acid, 0.5 parts of methylenebisacrylamide, 0.5 parts of sodium persulfate, a trace of wetting agent, organic amino compounds as indicated in the tables below, and water to make the total up to 100 parts by weight. Cotton fabric was employed. Impregnation, cures, washing procedures and drying procedures were similar to those described in example 5. The results are summarized in the following table.

| Organic Amine | Extent of Neutralization with Amine | Conversion (%) |
|---|---|---|
| Diethylamine | to pH = 7.0 | 51%[a] |
| Ethylenediamine | to pH = 7.0 | 75%[b] |
| Diethylaminoethyl acrylate | to pH = 5.0 | 59%[c] |

[a]Only 24% of the original amine remained in the final fixed on the fabric.
[b]As measured by nitrogen-content of the dry fabric containing the fixed polymer, 63% of the amine remained with the polymeric acid.
[c]In this case, 48% of the amino compounds remained associated with the polymeric acid that was fixed on the fabric.

Triethanolamine, tetramethylammonium hydroxide, and tetra(hydroxyethyl) ammonium hydroxide, when employed as above to bring the pH of acrylic acid into the range of 5–7, yielded results very similar to those obtained and described for ethylenediamine. In the case of pyridine and piperazine, the results were generally similar to those obtained with diethylamine.

EXAMPLE 7

Reagent solutions were made up to contain 7.25 parts of polymerizable carboxyl-containing monomer, 7.25 parts of comonomer, 0.5 parts of methylenebisacrylamide, (MBA) or 0.2 parts of tris(acryloyl)hexanhydro-s-triazine(THT), 2.0 parts of sodium persulfate, 0.1 part of wetting agent (Tergitol TMN), base to adjust the pH to a value of 7.0, and water to bring the total to 100 parts by weight. Samples of durable-press cotton/polyester (50/50) fabric were impregnated with the reagent solutions, cured for 5 minutes at 120° in an atmosphere of steam-nitrogen, washed vigorously for 20–30 minutes in hot running tap water and boiled for one-hour in distilled water, and air dried. The results that were obtained from these polymerizations with and without the adjustment of the pH with base are summarized in the following table.

| Carboxyl-containing Monomer | Di- or polyfunctional Monomer | Comonomer | Base | Add-on (%) | Conversion (%) |
|---|---|---|---|---|---|
| Acrylic acid | MBA | Hydroxyethyl methacrylate | None | 6.5 | 43 |
| Acrylic acid | | " | NaOH | 13.5 | 75 |
| Methacrylic acid | THT | Diacetoneacrylamide | None | 7.2 | 50 |
| Methacrylic acid | | " | | 12.8 | 75 |

The above results illustrate the beneficial effects that follow from the neutralization of the carboxyl-containing monomer in copolymerizations. These beneficial effects carry over into various combinations and various ratios of combinations of carboxyl-containing monomers with comonomers.

EXAMPLE 8

Swatches of cotton fabric were treated with reagent solutions containing 14.5 parts of acrylic acid, 0.5 parts of methylenebisacrylamide, 0.5 parts of ammonium persulfate, a trace of wetting agent, base to adjust the pH to a value of 7, and water to bring the total to 100 parts. Cures were conducted at 120° for five minutes in a steam-nitrogen atmosphere. Samples of fabrics were washed vigorously in hot running tap water and given a one-hour boil in distilled water. Samples were air dried at room temperature and efficiencies of conversion of monomer to polymer were calculated from the wet pickups of reagent solution and the add-ons of durable polymer. These results are listed in the following table under the heading of "efficiency of polymerization." These same samples were subjected to a one-hour boil in 2% caustic containing 0.1% of surfactant (Triton 770). The percentage of the original polymer that was lost during this process is listed under the heading of loss during caustic scouring. Finally, the samples of fabric were soaked in 2% acetic acid and rinsed thoroughly. The weight loss that occurred as a result of this step is listed under loss due to acid scouring. Also summarized in the following table are data obtained from a sample of acrylic acid/cotton fabric graft copolymer prepared by the conventional high-energy irradiation initiation process.

| Process | Efficiency of Polymerization (%) | Loss of Polymer Due to Caustic Scouring (%) | Loss of Polymer Due to Acid Scouring (%) |
|---|---|---|---|
| Acrylic acid neutralized with $NH_4OH$ | 70 | 3 | 18 |
| Acrylic acid neutralized with NaOH | 100 + | 13 | 13 |
| Acrylic Acid unneutralized | 29 | 38 | 33 |
| Acrylic acid neutralized with $Ca(OH)_2$; no difunctional monomer | 95 | 64 | 100 |
| Acrylic acid graft polymerized by high energy irradiation | — | 61 | — |

EXAMPLE 9

A reagent solution was prepared to contain 14.5 parts of acrylic acid, neutralized to pH 7 with sodium hydroxide, 0.5 parts of methylenebisacrylamide, 0.5 parts of ammonium persulfate, a trace of wetting agent, and water to bring the total to 100 parts by weight. Samples of fibrous materials were immersed in this solution, squeezed with rollers to express the excess reagent solution, subjected to cures for 5 minutes at 120° C in atmospheres of steam-nitrogen, washed vigorously in hot running tap water, boiled for one hour in distilled water, and air-dried at room temperature. The efficiencies of conversion of monomer on fabric to polymer durably fixed on fabric were calculated on the basis of the wet pickup of reagent solution and the durable polymer add-on to the fabric after the cure, etc. Results are summarized in the following table.

| Fibrous Composition | Efficiency of Fixation (%) |
|---|---|
| Cotton Batting | 100 |
| Cotton Pickerlap | 100 |
| Cotton Yarn | 100 |
| Paper | 100 |
| Nylon Tricot | 70 |
| Polyester (polyethylene terephthalate) | 98 |
| Cellulose Acetate | 82 |
| Polypropylene Fabric | 79 |
| Spandex-nylon | 95 |
| Acrylic Fabric (Orlon) | 100 |
| Wool | 100 |
| Flax | 98 |
| Cotton/Polyester (50/50) | 100 |
| Cotton/Polyester (35/65) | 95 |
| Durable Press Cotton/Polyester (35/65) | 95 |

The efficiencies in these fixations of network polymer on the various substrates are almost independent of the nature of the substrate. Variation appears to be a function of the proper preparation of the substrate (removal of oils, lubricants, etc.) and the degree of wetting of the surface of the substrate that is achieved by the reagent solution, which is dependent upon the effectiveness of the wetting agent and, to some degree, upon the nature of the base used to neutralize the carboxyl-containing monomer.

EXAMPLE 10

In this example, the contribution of fixed polymer to fabric performance properties is illustrated. The illustration is based on treatment of an 80 ×80 cotton print cloth that was desized, scoured, and bleached prior to fixation of various levels of poly(sodium acrylate) network polymer on the fabric. The polymer was fixed on the cotton fabric by use of reagent solutions containing acrylic acid, methylenebisacrylamide, wetting agent, sodium hydroxide to adjust the pH to 7.0, and water. The concentrations of agents ranged downward from the 15% concentration of total monomers that is generally illustrated in the preceding examples.

Cures were conducted in the normal manner; all samples were given extensive washes in hot running tap water, boiling water, and boiling 2% caustic prior to air-drying and evaluation. Results are summarized in the following table.

| Performance Property | Unmodified Cotton | Cotton Containing Fixed Polymer | | |
|---|---|---|---|---|
| | | 2% Add-on | 5% Add-on | 10% Add-on |
| Moisture Regain | 6.3% | 7.8% | 9.3% | 11.6% |
| Wicking Time (3 cm.) | 48 sec. | 17 sec. | 22 sec. | 26 sec. |
| Water Vapor Permeability(g/24 hr.) | 3.96 | 4.17 | 4.10 | 4.04 |
| Bending Moment ($\times 10^{-4}$ in. lb.) 4.3 | 4.0 | 3.4 | 6.2 | |
| Wet Wrinkle Recovery Angle (°, W+F) | 151 | 165 | 188 | 210 |
| Water of Imbibition | 31 | 40 | 52 | 62 |

The increase in hydrophilic characteristics which are illustrated in this table and which are contributed to cotton fabric by the fixation of poly)sodium acrylate) in the cotton fabric carry over into other fibrous substrates. In general, the same performance characteristics that are listed above are increased when the same treatment is applied to cotton/polyester blend, 100% polyester, nylon, and acrylic fabric. The deposition and fixation of other polymers, that are exemplified in the disclosure of this invention, in various fibrous substrates generate increases in these same performance properties, although to degrees which depend upon the specific carboxyl-containing monomer, the comonomer, and the base involved in the neutralization of the carboxyl-containing monomers. On essentially all fibrous substrates, the carboxyl-containing polymers and copolymers contribute soft hand or full-bodied mellow hand. In all cases, soil release is improved, the improvement being the smallest for the fibrous substrate that starts out most hydrophilic in nature, such as cotton fabric, and the improvement being the largest in the case of the fabric which starts out most hydrophobic, such as polyester fabric. The polymer illustrated in this example contributes antistatic properties to hydrophobic fibrous substances such as nylon, polyester, and polypropylene.

EXAMPLE 11

A network polymer of acrylic acid and methylenebisacrylamide was applied to polyester fabrics by the general procedure described in Example 8; sodium hydroxide was employed to neutralize the acrylic acid and to bring the pH to 7.0. The samples of fabric were evaluated for change in wettability characteristics: the wicking test is a measure of the rate at which an aqueous solution of dye rises a vertical distance of 2 cm. and the results are expressed in seconds. The drop absorbency test is a measure of the time required for the complete absorption of a drop of water into the fabric; the time is recorded in seconds. In both of these cases the shorter the time, the better the hydophilic characteristics are for the fabric. Results are summarized in the following table.

| Fabric | Add-on (%) | Wicking Time (2 cm.) sec. | Drop Absorbency sec. |
|---|---|---|---|
| Pocketing fabric | | | |
| original fabric | — | 1200+[a] | 1200+[b] |
| treated fabric | 6.8 | 345 | 66.3 |
| Twill fabric | | | |
| original fabric | — | 128.3 | 47.4 |
| treated fabric | 13.8 | 22.3 | 1.7 |
| Knit fabric | | | |
| original fabric | — | 1200+[a] | 1200+[b] |
| treated fabric | 12.9 | 47.7 | 2.0 |

[a]In these cases the aqueous solution did not reach the 2 cm. level in the course of 1200 seconds.
[b]In this case a drop of water was not absorbed in the course of 1200 seconds.

EXAMPLE 12

A series of reagent solutions was prepared to contain itaconic acid (9.7 to 14.5%), methylenebisacrylamide (0.3 to 0.5%), sodium persulfate(0.3 to 0.5%), and water; in some cases, sodium hydroxide was added in molar equivalence to the itaconic acid. Cotton fabric was treated, cured, and washed as described in Example 4. The efficiency of conversion of monomer to polymer on fabric when the acid waS unneutralized was approximately 50%; when sodium hydroxide was introduced as indicated above, the efficiency of the conversion of monomer to polymer was 74–83%.

EXAMPLE 13

A series of cotton fabrics, cotton/polyester blend fabrics, and polyester fabrics was treated by the procedure described in Example 4 to introduce various levels of poly(sodium acrylate). After extensive rinsing in hot tap water and then boiling these samples for one hour in distilled water, it was found that approximately 60% of the stoichiometric amount of Na remained relative to the poly(acrylic acid). Comparison of textile properties of these modified fabrics with a corresponding set of fabrics containing unneutralized poly(acrylic acid) showed the following:

| | |
|---|---|
| Stoll flex abrasion resistance: | equivalent at comparable add-on |
| Breaking strength: | equivalent at comparable add-on |
| Elongation: | generally similar |
| Stiffness: | lower for cotton-containing compositions bearing poly(acrylic acid) in Na form |
| Comfort-related hydrophilic characteristics (these include moisture regain, water of imbibition, wicking time, drop absorbency, and water vapor transmission) | |
| Soil resistance and release: | very substantial superiority of poly(sodium acrylate)-fabrics in resistance to and release of aqueous soil and release of oily soil. |

It is notable that stiffness is lower for the poly(sodium acrylate)-fabrics compared to the poly(acrylic acid)-fabrics; the former, in the case of the cotton-containing compositions, were even lower in stiffness than the original unmodified fabrics until add-ons of approximately 8% were reached. The substantial superiority of the poly(sodium acrylate)-fabrics in soil resistance and release was maintained even though the laundry detergent contained basic materials (phosphates or carbonates) normally capable of introducing alkali metal ions into a polycarboxylic acid such as poly(acrylic acid).

Fabrics modified to contain poly (acylic acid) in the form of Li, K, $NH_4$ or amine salts showed similar superiorities over the unneutralized poly(acrylic acid)-fabrics.

Fabrics modified to contain poly(sodium methacrylate) according to Example 5 or poly(sodium itaconate) according to Example 12 exhibited superiorities over the unneutralized polymer-modified fabrics similar to those summarized above for the poly(sodium acrylate)-fabrics.

Fabrics modified to contain copolymers of acrylic acid, methacrylic acid, or itaconic acid with substantial portions of the carboxyl groups neutralized to introduce Na, K, Li, $NH_4$ or amine cations exhibited trends of performance property differences in the direction indicated above. In cases involving non-ionic comonomers the efficiency of conversion of monomers and performance of the modified fabric were superior when the carboxyl-containing monomers were neutralized to or above pH 3.6; the desirable differences summarized above for the poly(cation acrylate)-fabrics became disappearingly small as the mole ratio of carboxyl-containing monomer to comonomer decreased below 0.3:1.0. The preferred comonomers in this regard include amides of acrylic and methacrylic acids and hydroxyalkyl esters of acrylic acid and methacrylic acid: specifically, they are acrylamide, methacrylamide; N-methylol acrylamide and methacrylamide; hydroxyethyl acrylamide and methacrylamide; diacetoneacrylamide, hydroxymethyldiacetoneacrylamide; and hydroxyethyl and hydroxypropyl acrylates and methacrylates.

Although illustrations of the process and products have been given in terms of fabric, the treatments can be applied equally as well to fibers in the form of batting, pickerlap, sliver, roving, or yarn. The following are among the substrates that may be treated beneficially by the process of this invention: cotton fibers and fabrics; rayon fibers and fabrics; paper, non-woven fabrics; nylon fibers and fabrics; polyester fibers and fabrics; blends of cotton fibers with nylon, polyester and other fibers; cellulose acetate and triacetate fibers and fabrics; polyethylene and polyproplene fibers and fabrics; spandex fibers and fabrics; acrylonitrile polymer and copolymer fiber and fabrics; wool, silk, jute, ramie, and flax fibers and fabrics.

We claim:

1. A process for preparing cellulosic or synthetic fibers having hydrophilic, soil-release and anti-static properties comprising:

a. wetting a cellulosic or synthetic fiber in an aqueous solution consisting essentially of a water-soluble carboxyl containing acrylic or vinyl monomer, a water-soluble non-acidic acrylic or vinyl monomer a water-soluble free radical initiator, said aqueous solution having a pH greater than 3.6 and a water content of about 85 weight percent; and b. curing the wetted fiber from (a).

2. The product prepared by the process of claim 1.

3. A process for preparing cellulosic or synthetic fibers having hydrophilic, soil-release and anti-static properties comprising:

a. wetting a cellulosic or synthetic fiber in an aqueous solution consisting essentially of a water-soluble carboxyl containing acrylic or vinyl monomer, a water-soluble free radical initiator, said aqueous solution having a pH greater than 3.6 and a water content of about 85 weight percent.

4. The product prepared by the process of claim 3.

* * * * *